United States Patent [19]

Rosset et al.

[11] 4,243,496

[45] Jan. 6, 1981

[54] PROCESS FOR THE FORMATION OF PROTECTING COATINGS ON ZINC SURFACES

[75] Inventors: Robert H. Rosset, Paris; Alain P. Jardy, Montrouge, both of France

[73] Assignee: Chaffoteaux et Maury, Montrouge, France

[21] Appl. No.: 40,454

[22] Filed: May 18, 1979

[30] Foreign Application Priority Data

May 19, 1978 [FR] France ..... 78 14950

[51] Int. Cl.[3] ..... C25D 11/36

[52] U.S. Cl. ..... 204/56 R

[58] Field of Search ..... 149/6; 204/56 R

[56] References Cited

U.S. PATENT DOCUMENTS

| | | | |
|---|---|---|---|
| 2,125,387 | 8/1938 | Mason | 204/56 R |
| 2,132,438 | 10/1938 | Romig | 204/56 R |
| 3,011,958 | 12/1961 | White | 204/56 R |
| 3,898,139 | 8/1975 | Watanabe et al. | 204/56 R |

*Primary Examiner*—R. L. Andrews

*Attorney, Agent, or Firm*—Cushman, Darby and Cushman

[57] ABSTRACT

The invention relates to the protection of zinc surfaces by depositing a protecting coating.

The process of the invention comprises the formation of a pyrophosphate coating by electrolytic oxidization of the articles treated in contact with a solution containing pyrophosphate ions or ions capable of giving pyrophosphates.

The invention is particularly useful for protecting galvanized objects in contact with aqueous environments.

15 Claims, No Drawings

PROCESS FOR THE FORMATION OF PROTECTING COATINGS ON ZINC SURFACES

BACKGROUND OF THE INVENTION

The invention relates to a process for forming protecting coatings on zinc surfaces. It also relates to compositions used for implementing this process and objects having a coating such as obtained by said process.

Zinc surfaces and particularly surfaces obtained by galvanization of ferrous metals are susceptible to corrosion. In particular, during extended use, natural waters form aggressive environments with respect to galvanized objects.

To protect zinc surfaces and particularly surfaces obtained by galvanization, but also, if such be the case, to facilitate certain subsequent treatments, it is known to form on the zinc a protecting surface layer of insoluble phosphates.

This coating, in the techniques known up to present, is provided by contacting the parts with a treating solution containing phosphate ions. The deposit of insoluble salts from this solution results in the chemical shifting of a balance in which the constituents of the solution share of course, but also the metal of the treated surface. In this operating, the parameters which influence the result obtained are multiple. The principal ones are of course bound up with the composition of the solution (nature and concentration), with its pH, but other factors such as the temperature, the duration of the treatment, etc . . . , also play a role.

In general, treating solutions for forming a phosphate protecting deposit contain one or more phosphates soluble in an acid solution. This solution, in contact with the metal surface, produces a slight etching of the metal and the precipitation of insoluble zinc phosphates.

These known techniques are tricky to implement. For satisfactory operation, as we have pointed out, the solutions must have a series of very definite characteristics. Now, the use of these solutions leads rapidly to a modification of these characteristics, so that the user is compelled to check and adjust permanently their composition. In the absence of the right conditions, either the deposit is not formed, or it is accompanied by undesirable phenomena, and particularly by heavy precipitations of sludges which affect the quality of the coating and lead to a wasteful deterioration of the solution.

Another kind of difficulty is bound up with the fact that, for treatments against corrosion, the period of formation of the coating is usually several hours, even several days. The length of the treatment is all the more troublesome since it is most often carried out at temperatures above room temperature and requires permanent heating.

For all these reasons, the known processes are inconvenient to implement and are relatively expensive.

Whatever the measures taken to maintain the treatment solution in the best conditions, the results obtained are not always satisfactory, one of the defects the most often encountered being the lack of uniformity of the coating on a same batch of articles, or even at different parts of the same article. It is known, in the field of anti-corrosion protection, how important it is to provide perfectly uniform coatings without which the corrosion phenomena concentrate at the place where the coating is wanting, thus leading to rapid deterioration of the article considered. One reason for this type of defect is the difficulty in obtaining homogeneous conditions of contact of the solution with the surface to be treated. So, to limit the risk of such defects, efforts are made to ensure agitation of the articles or a flow of the solution, which leads to additional expense for the implementation of these processes.

SUMMARY OF THE INVENTION

Taking into account what has just been pointed out, the applicant has endeavoured to find a process which would eliminate, or at least reduce, the disadvantages found up to now in the protection treatments for zinc surfaces, and particularly for galvanized surfaces.

This has been obtained by the present invention which consists of a process for forming on a zinc surface a coating of zinc pyrophosphates, characterized in that the articles whose surfaces are to be coated are subjected to electrochemical oxidization in an electrolyte containing pyrophosphate ions or phosphate ions capable of giving pyrophosphates by chemical balance shifts.

The oxygenated acid kinds of phosphorus with the degree of oxidization V and the corresponding ions are very varied. They are particularly the orthophosphates, the pyrophosphates, the metaphosphates. Associated acids are also known in the macromolecular form, whose average composition is intermediate that of the pyrophosphoric and metaphosphoric acids. All these kinds in an aqueous solution give rise to balances and, according to the overall concentration, the pH, the temperature, the proportions of each of them may vary.

It is preferable, in accordance with the invention, to choose a solution in which the condensation into phosphorus of the phosphate ions present is close to that which corresponds to the pyrophosphates, or else is greater than this condensation.

In the description which follows, there will then be designated, for simplicity's sake, by phosphate or else pyrophosphate solution a solution in which different kinds may coexist.

Similarly, in the description and the examples which follow, the protecting coating formed is designated as being of zinc pyrophosphate. The analysis of the coating shows in fact that zinc pyrophosphate is the essential constituent of the deposit formed in the preferred conditions for implementation of the process of the invention. It may however happen that other insoluble zinc phosphates are precipitated with the pyrophosphate.

To prepare the electrolyte, a soluble pyrophosphate solution is advantageously used containing accordingly phosphate and in particular pyrophosphate ions.

It is also possible to prepare the electrolyte used for the formation of the pyrophosphate coating from other polyphosphates or from a mixture of polyphosphates capable of giving pyrophosphates in conditions which are those for using this electrolyte. As we have already pointed out, it is well known in the prior art particularly that polymetaphosphate ions possibly mixed with orthophosphate ions may give rise, in solution and by balance reactions, to mixtures of ions containing in particular pyrophosphates.

Consequently, what is indicated in the following description, while referring for convenience's sake to pyrophosphate solutions, is also valid for other phosphate solutions, and in particular for polymetaphosphate possibly mixed with orthophosphates, as long as they may give rise to pyrophosphates in the conditions of use described.

The solutions may also be prepared from orthophosphates by dehydration by means of phosphoric anhydride $P_2O_5$.

Pyrophosphates are on the whole not very soluble, and in practice, to obtain sufficiently concentrated solutions, we are led to choosing those whose solubility is the highest possible. For this reason, we use preferably, according to the invention, an alkaline pyrophosphate solution, particularly those of sodium or potassium.

The polyphosphate and particularly pyrophosphate ion content of the solution is limited to an upper value by the solubility characteristics. This content may be increased without leading to the formation of precipitate by modifying for example the pH conditions of the solution. Conversely, the presence of cations likely to give rise to compounds which are very little soluble, particularly $Zn^{2+}$ ions, reduces the admissible pyrophosphate ion content.

In other words, the solubility conditions of the cation phosphates considered insoluble depend not only on the respective phosphate and cation ionic concentrations but also on the pH range of the solution, it being understood that, when we speak of insoluble phosphates, we refer to neutral solutions or solutions which do not deviate too much from neutrality.

Moreover, it is advantageous to operate with a solution whose pyrophosphate content is as high as the solubility conditions permit so as to facilitate and accelerate the formation of the deposit during the treatment according to the invention.

A solution is advantageously used whose overall phosphate content expressed in phosphorus is between 0.6 and 12.5 g/l. Typically, when the solution is prepared from sodium pyrophosphate, we use 0.01 to 0.2 mole/l, and preferably about 0.1 mole/l, i.e. 44.6 g/l of $Na_2P_2O_7$, 10 $H_2O$.

According to the invention, it is preferable to use a slightly acid electrolyte. In fact, a basic solution could cause a modification of the structure of the deposit by formation of basic salts or zinc hydroxides and, at the limit, could cause the dissolution of the zinc of the article treated. It is advantageous to operate with an electrolyte whose pH is less than 6.

A very acid solution is not desirable either. Such a solution, while favouring the solubility of the zinc phosphates, would retard the formation of the desired coating. Furthermore, if the solution is very acid, it may inappropriately attack the zinc surface to be coated. According to the invention, the electrolytes used have advantageously a pH which is not less than 2.5.

Furthermore, according as to whether the electrolysis is carried out with a DC current or an AC current, which will be discussed further on, the pH conditions preferred vary a little. Advantageously, if we operate with a DC current, the pH is between 2.7 and 3 and if we operate with an AC current, between 4.5 and 5.

The choice of the acid used for adjusting the pH is not critical. It is most advantageous to acidify by means of phosphoric acids and in particular orthophosphoric acid, these acids contributing to the establishment of the desired phosphate ion content, but other acids, particularly sulfuric acid, may be used.

Besides the pyrophosphate ions (or the ions giving pyrophosphates) which are indispensable for the formation and the use of the electrolyte used in the process of the invention, it is possible to add other compounds in order to improve the results and to make it easier to obtain them. It is thus advantageous to introduce into the electrolyte compounds releasing $Zn^{2+}$ ions. In fact, as has already been pointed out, the precipitation of zinc phosphate on the treated surface results from the imbalance caused by the $Zn^{2+}$ ions formed by electrochemical oxidization in contact with the surface itself. The presence of $Zn^{2+}$ ions in the solution, before electrochemical oxidization, facilitates the formation of the precipitate by bringing the solution close to the limit conditions of solubility, and the required electro-chemical oxidization of the treated surface is all the more limited the closer the composition is in zinc and phosphate contents beyond which precipitation would begin.

It is evident that the addition of compounds releasing zinc ions is limited so that no precipitate is formed before the electrochemical oxidization of the surface has begun. The admissible $Zn^{2+}$ ion content depends principally both on the phosphate ion content and on the pH of the solution.

With the phosphate content and pH indicated above, and providing that the conditions of solubility which have been seen are respected, an electrolyte is advantageously used whose $Zn^{2+}$ content may go up to $8.10^{-3}$ ion g/l.

By way of indication, while taking into account the influence of the pH, for the same pyrophosphate ion content of 0.1 ion g/l, we use advantageously, at pH 3, $2.5\times10^{-3}$ ion g/l of $Zn^{2+}$, and $6\times10^{-3}$ ion g/l when the pH is lowered to 2.7.

As the compound introduced into the electrolyte for releasing therein $Zn^{2+}$ ions, we may advantageously use zinc chloride or zinc oxide. When zinc oxide is used, account must necessarily be taken of its own basicity and the quantities of acid used must accordingly be modified to maintain the pH of the solution within the preferred values.

The temperature at which the process of the invention is carried out is not critical. This temperature is however not unimportant. An increase in temperature causes antagonist effects, on the one hand, an increase in the solubility of the phosphates, which is consequently contrary to the formation of the precipitate, on the other hand, an increase in the chemical kinetics of the process corresponding to the shift of the balances, which favours the formation of the precipitate. On the whole however, it seems that the second effect predominates and that an increase in temperature accelerates the formation of the deposit.

We operate advantageously, according to the invention, at a temperature between 20° and 70° C., preferably at about 60° C.

In practice, since electrolytic baths tend to heat up by Joule effect, when they are in operation, we can use the temperature which is established by itself, without it being necessary to reheat them or cool them.

In the implementation of the process of the invention, electrolysis is carried out in a conventional way, with an electrolyte such as defined above.

It is possible to carry out the electrolysis with DC current or AC current. In both cases, a zinc pyrophosphate deposit is obtained generated by the surface anodic oxidization of the zinc of the treated article.

When we operate with DC current, the treated article is placed at the anode of the electrolysis device. The electrolytic efficiency is all the better the closer the electrolyte used is to the precipitation conditions of the insoluble phosphates. Oxidization even very limited of the anode, while modifying the balance conditions of the electrolyte, then allows formation of the desired deposit.

Still when operating with DC current, the modification of the balance conditions of the electrolyte by the cathodic reaction is to be avoided, and particularly deposit of the zinc is to be avoided. To this end, the anode and cathode compartments are separated by means of a membrane not letting the $Zn^{2+}$ ions pass. Membranes of this type are well known in the fields of industrial electrochemistry; they may be asbestos membranes or membranes of anion exchanger resins.

We do not know in detail with certainty the mechanisms which lead to the formation of the phosphate coating when we operate with AC current and when the treated zinc surface plays successively the role of anode and cathode. Earlier studies for other systems have shown nevertheless that, in AC current electrolysis, the formation of an "insulating" coating tends to be accompanied by a rectifying effect at the half-wave which does not generate the formation of the coating.

In addition to the advantage of using a current which does not need to be rectified, it has been discovered that AC operation may lead to a more even deposit with a finer grain.

We may reasonably think that in the present case, when the elctrolysis is carried out with a zinc electrode on which the pyrophosphate deposit behaves as an insulator, the reaction mechanisms are indeed of this nature. However that may be, the formation of the desired pyrophosphate coating is in fact obtained.

An additional advantage obtained by using AC current in accordance with the invention is that it becomes unnecessary to use a diaphragm. This is particularly advantageous when the contemplated treatment requires the use of devices (tanks, electrodes . . . ) having complex shapes.

The cathode is chosen in a material such that it remains stable in contact with the electrolytic solution and, consequently, does not modify the composition thereof. Steel, lead or graphite cathodes may be used in particular.

To carry out the electrolysis forming part of the process of the invention, the only requirement for the electric parameters is that the voltage applied to the electrodes is sufficient, under operating conditions, for the electrochemical surface oxidization of the zinc of the treated articles to be produced. This voltage depends on numerous factors: nature of the electrolyte, nature and configuration of the electrodes, disposition of the electrodes, resistance of the diaphragm, etc . . . . In practice, the voltage is set so that the oxidization of the zinc of the treated articles takes place evenly, which may be controlled by the anodic current density.

The voltage applied must not exceed that which would result in electrolysis of the water of the solution used, failing which, other than adverse modifications of the bath, the faradic efficiency of the operation would be substantially lowered. Preferably, with DC, we use current densities of the order of 40 $A/m^2$. It is of course possible to operate with lower current densities, but the formation of the deposit is then slower and the treatment is longer for a deposit of the same size.

By way of indication, potential differences applied to the experimental electrolytic systems, and which allowed current density values indicated above to be obtained, range between about 2 and 4 volts. But, as has been said, these values are not limitative for they depend on factors which may be modified at will without departing from the scope of the process forming the subject matter of the invention.

With AC current, the effective current densities and voltage applied are higher. Advantageously, the current density is adjusted to values from 40 to 100 $A/m^2$. Similarly as before, by way of indication, to establish current densities of the order of those which have just been indicated and for the installations used, the voltages applied are between 5 and 10 V.

The duration of the treatment varies according to the extent of the deposit desired, but it also depends on numerous factors such as current density, temperature, concentration of the solution, etc . . . .

When the treatment according to the invention has as its aim the complete formation of a protecting coating, given as we have pointed out the insulating character of the pyrophosphate layer deposited, the treatment is continued until the applied voltage required becomes too high, risking causing electrolysis of the water or "break down" of the protecting coating.

By way of example with DC current, by applying an initial current density of 40 $A/m^2$ with an electrolyte complying with the preferred conditions defined above, the protection is finished in about 30 minutes.

Treatments leading to thinner coatings may also be practiced thanks to the invention.

It is also possible to combine the process of the invention with other methods of treatment, and particularly with purely chemical processes, for the formation of protecting coatings. The advantage of treating electrolitically, in accordance with the invention, objects having been previously subjected to a protection by chemical deposit of insoluble phosphates comes from the fact that the deposit obtained by electrochemical means will be located at the exact points where the first coating is lacking or is insufficient. Thus, by means of a limited additional treatment, the defects are healed over and a very even coating is obtained, which is indispensable for guarantying an efficient protection.

If required, the order of the electrochemical treatment according to the invention and the chemical treatment according to conventional methods may be reversed.

Generally, articles having the most varied shapes may be treated by the process of the invention. As far as possible, it is preferable to operate so that the electric field lines are evenly distributed at the surface of the treated article. This may be promoted by conventional means such as, for example, the use of associated electrodes having special shapes.

The efficiency of the protection conferred by the treatment of the invention has been verified on samples of galvanized sheet iron. These tests were carried out, on the one hand, by determining the polarization curves or the current-potential curves of the treated samples in relation to those of check samples and, on the other hand, by subjecting the treated samples and check samples to accelerated corrosion tests by contact with aerated solutions containing copper and chloride ions.

The results obtained show the excellent corrosion resistance of the treated samples in relation to the check samples.

It is apparent that within the scope of the invention, modifications and different arrangements can be made other than is here disclosed. The present disclosure is merely illustrative with the invention comprehending all variations thereof.

We claim:

1. A process for forming on a zinc surface a coating formed from zinc pyrophosphate, wherein the articles whose zinc surfaces are to be coated, are placed in contact with an electrolyte consisting essentially of pyrophosphate ions or phosphate ions capable of giving pyrophosphates, and are subjected to electrolytic surface oxidation of the zinc thereby causing precipitation of the zinc pyrophosphate.

2. The process as claimed in claim 1, wherein the electrolyte is formed by dissolution of one or more soluble phosphates selected from the group consisting of pyrophosphates, metaphosphates, polyphosphates, or mixtures thereof and orthophosphates, or of the corresponding acids.

3. The process as claimed in claim 2, wherein the phosphate ion content of the electrolyte solution, expressed as phosphorus, is between 0.6 and 12.5 g/l.

4. The process as claimed in claim 1, wherein the electrolyte is adjusted to a pH between 2.5 and 6.

5. The process as claimed in claim 4, wherein the electrolyte also contains $Zn^{2+}$ions going up to a concentration of $8\times10^{-3}$ ion g/l.

6. The process as claimed in claim 1 or 2, wherein the temperature of the electrolyte is between 20° and 70° C.

7. The process as claimed in claim 1, wherein the electrolysis is continued until an insulating deposit is formed on the treated zinc surface.

8. The process as claimed in claim 1, wherein, when DC current is used, the treated articles are placed at the anode of the electrolysis device.

9. The process as claimed in claim 5, wherein cathodic reduction of the zinc ions is prevented by separating the cathode of the electrolyte with a membrane preventing the passage of said ions.

10. The process as claimed in claim 1, 2 or 4, wherein AC current is used.

11. The process as claimed in claims 1, 2, 4 or 7, wherein the electrolysis is conducted by applying a voltage sufficient to cause surface oxidation of the zinc of the treated article, and is less than that which would be accompanied by electrolysis of the water of the solution.

12. The process as claimed in claim 1, wherein said electrolyte is a solution which is formed by dissolving of one or more soluble phosphates selected from the group consisting of pryophosphates, metaphosphates, polyphosphates, or mixtures thereof and arthophosphates, or of the corresponsing acids, and wherein said solution has a pH between 2.5 and 6.

13. The process as claimed in claim 12, wherein, overall, the condensation into phosphorus of the phosphate ions in solution is close to or greater than that corresponding to the pyrophosphates.

14. The process as claimed in claim 12 or claim 13, wherein the phosphate content, expressed as phosphorus, is between 0.6 and 12.5 g/l.

15. The solution as claimed in claim 12 or 13, wherein said solution also contains $Zn^{2+}$ ions in an amount up to $8\times10^{-3}$ ion g/l, but remaining less than that corresponding to the maximum solubility value, taking into account the phosphate concentrations and the pH of said solution.

* * * * *